United States Patent [19]

Fisher

[11] 4,143,662

[45] Mar. 13, 1979

[54] BRASSIERE

[76] Inventor: Marlene J. Fisher, 18 Edinborough Ct., Apt. 5, Toronto, Ontario, Canada, M6N 2E8

[21] Appl. No.: 804,143

[22] Filed: Jun. 6, 1977

[30] Foreign Application Priority Data

Jun. 16, 1976 [GB] United Kingdom ..... 24976/76

[51] Int. Cl.[2] ..... A41C 1/14

[52] U.S. Cl. ..... 128/477; 128/510

[58] Field of Search ..... 128/500, 477, 490, 491, 128/481, 464, 510

[56] References Cited

U.S. PATENT DOCUMENTS

| | | | |
|---|---|---|---|
| 1,994,359 | 3/1935 | Greenbaum | 128/500 |
| 2,191,545 | 2/1940 | Schneider | 128/464 |
| 3,799,174 | 3/1974 | Howard | 128/464 |

FOREIGN PATENT DOCUMENTS

| | | | |
|---|---|---|---|
| 2541440 | 3/1977 | Fed. Rep. of Germany | 128/500 |

*Primary Examiner*—Werner H. Schroeder
*Assistant Examiner*—Doris L. Troutman
*Attorney, Agent, or Firm*—Sim & McBurney

[57] ABSTRACT

This invention provides a brassiere construction comprising two cup portions and supporting strap portions. Each cup portion has a rounded lower periphery and tapers toward the top, and the strap portions include straps defining the peripheries of the cup portions. The cup portions are of unshaped, initially flat stretchable material attached to the straps, while a band of substantially non-stretch material is attached to the stretchable material of each cup portion along the rounded lower periphery thereof.

4 Claims, 2 Drawing Figures

BRASSIERE

This invention relates to the fabrication and construction of a brassiere.

In conventional "natural-look" seamless bras of the kind currrently fashionable, the fabric of the cup is moulded into a cup-shape before the bra is assembled, i.e., before the cup material is sewn or otherwise attached to the straps, etc. of the undergarment.

The process of moulding the cups into the cup material is expensive and time-consuming, and therefore adds considerably to the retail cost of the undergarment.

It is an aspect of the present invention to dispense with the necessity for pre-moulding a cup shape into the cup material prior to assembly of the undergarment, while still allowing the provision of a seamless bra of the "natural-look" type, capable of following the natural line of the body.

A conventional material utilized extensively for cups in the seamless-type bra in North America is a material generally known as Polyester Simplex. This is a material which is capable of receiving and retaining a distorted cup-shape in a moulding process involving the application of pressure and heat. The approximate current cost per cup in North America is 25 cents, while the original Polyester Simplex material itself currently costs approximately $2.00 per yard of 54 inch width.

Another fabric utilized for the cup portion of a bra is a material consisting of 18% Lycra (known as Lycra Spandex), with the remainder being Nylon. The approximate cost per yard of 54 inch width in the United States at the present time is just over $4.00. This material also requires heat-and-pressure forming into a cup, and therefore the per-cup cost using this more expensive material is greater than that for the Polyester Simplex.

The considerable cost of the individual cups made of the prior art materials in the prior art process adds significantly to the retail price of the finished undergarment.

It is with the aforementioned disadvantages of the prior art undergarments in mind that the present invention has been developed.

Accordingly, this invention provides a brassiere construction comprising two breast-supporting portions and supporting strap portions, each breast-supporting portion having a rounded lower periphery and tapering toward the top, the strap portions including straps defining the peripheries of the breast-supporting portions, said latter portions being of unshaped, initially flat stretchable material attached to the said straps, and a band of less stretchable material attached to the said stretchable material of each breast-supporting portion along the rounded lower periphery thereof.

Figure 2:
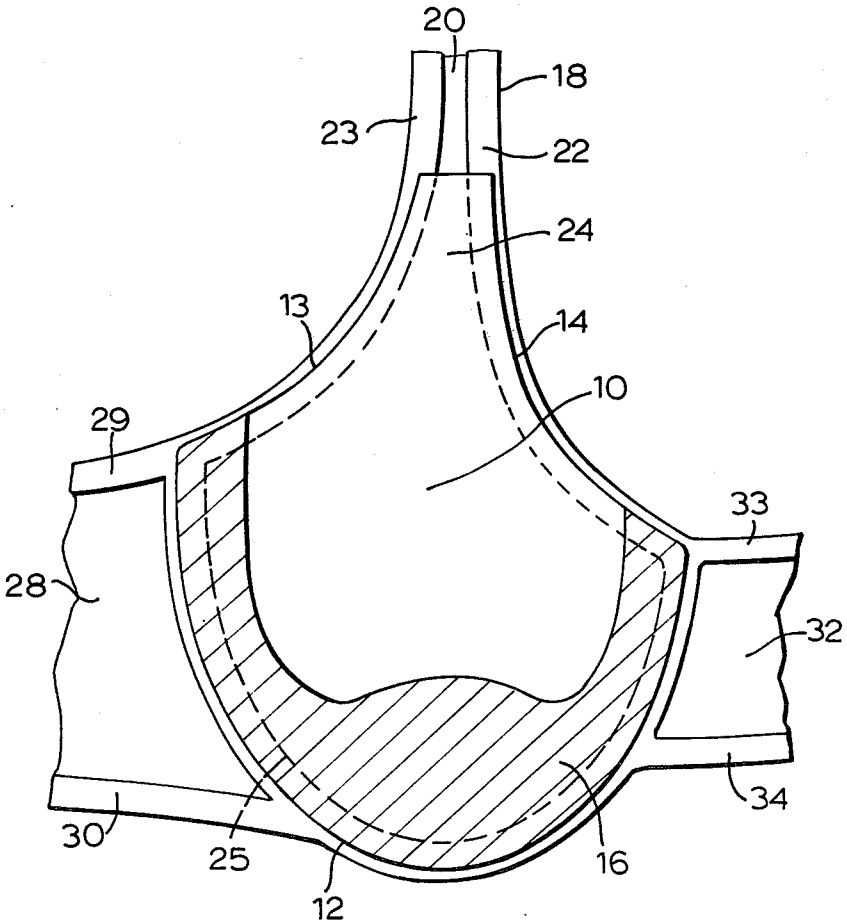
Figure 1:
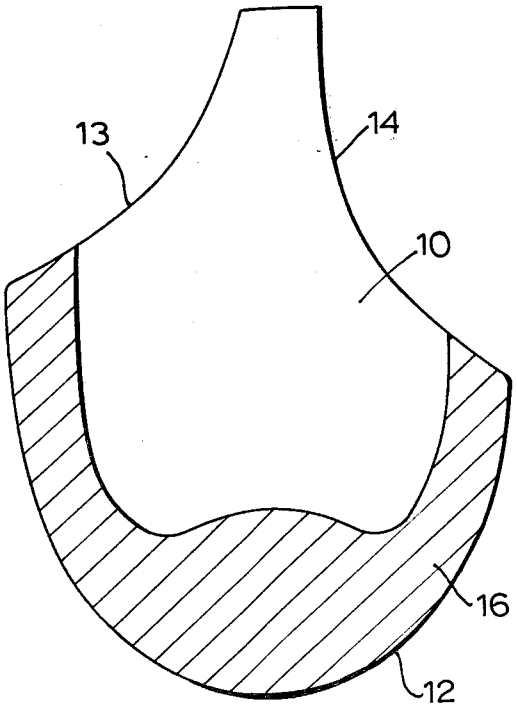

One embodiment of this invention is illustrated in the accompanying drawings, in which like numerals denote like parts throughout the several views, and in which:

FIG. 1 is a view of a cup component of a brassiere undergarment according to this invention; and FIG. 2 is a view of a portion of the completed brassiere, utilizing the component of FIG. 1.

The present invention obviates the necessity of utilizing pre-formed cups in the assembly of the undergarment, and moreover utilizes a stretchable material which, because it is not required to undergo a heat-and-pressure forming operation and retain the resultant cup shape, is considerably less expensive than the prior art materials.

The material preferred for use with this invention is a non-directional 100% nylon material of the kind currently used in "panty hose" undergarments. This material is capable of accepting a stretch of over 100% of its relaxed dimension without rupture in all directions, and it is this capability which is utilized to advantage in the present invention.

Referring now to the figures, this invention is carried out by providing firstly a roughly teardrop-shaped patch of the 100% nylon material, which is defined by a rounded lower periphery 12 and upwardly converging margins 13 and 14 which taper toward each other. It is to be understood that the patch 10 of nylon material is unshaped, and is initially flat.

In a preferred form of the invention, a band 16 of substantially non-stretch material is attached to the patch 10 of stretchable material along the rounded lower periphery thereof. The band 16 of substantially non-stretch material may be fused to the stretchable material of the patch 10, or may be attached thereto in any other conventional manner. Moreover, the attachment of the band 16 to the patch 10 may take place before or after the patch 10 is sewn or otherwise adhered to the straps and other support structure of the undergarment. The completed portion of the brassiere is shown in FIG. 2, in which it can be seen that a shoulder strap 18 with an internal web 20 and two thickened margins 22 and 23 is sewn into the upper tongue 24 of the patch 10, the margins 22 and 23 following and being sewn to the edges 14 and 13 respectively of the patch 10.

The strap structure also includes a circumferential margin 25 sewn or otherwise attached to the rounded edge 12 of the patch 10, a side strap 28 with marginal portions 29 and 30 adapted to encircle the chest-cage of the wearer, and a bridging strap 32 with marginal portions 33 and 34 adapted to connect the two cup portions together.

When not being worn, the nylon material of the patch 10 simply lies flat and has no cup shape whatever. However, when the wearer dons the garment, the inherent stretchability of the nylon material will deform to the natural line of the breast, while at the same time providing adequate support. Since the stretchable material follows the natural line of the body, the seamless "natural look" is retained.

The band 16 of undersupport material may be that known in the trade as "fibrefill." Alternatively, a fabric material such as woven cotton, silk, nylon, polyester, or 15, 20, 40 or 70 denier stabilized nylon tricot may be utilized.

Since the standard 100% nylon "panty hose" material cost is well below $1.00 per yard at the present time, and since the nylon material does not require a heat-and-pressure cup forming procedure to be carried out in order to work this invention, it follows that the final cost to the manufacturer and to the end purchaser of the undergarment will be greatly reduced from that presently found in the market.

A further reason why the procedure of the present invention effects an economy in the manufacture of undergarments of this type is related to wastage. In the conventional process, the machine contouring step requires a large excess around the cup, and this large excess is subsequently cut away and discarded at the time of assemblng the undergarment. In the present invention, no such large excess is called for, and the 100% nylon stretchable material may be cut to closely conform to the straps, etc. of the undergarment.

Yet another advantage attendant upon the present invention relates to the fact that the current process of machine moulding cups into fabric results in a high percentage of discrepancies in the sizes and contours of the moulded cups. At present, brassiere manufacturers have no choice but to accept this high percentage of discrepancies, because the necessary improvements in the moulding process have not yet been achieved. The undergarment of the present invention, because it adjusts itself to the individual breast line due to the stretchability of the fabric utilized, always forms a perfect cup by stretching and deforming to the required degree when worn. For this reason, the manufacturer does not need to be concerned with any cup contour discrepancies.

It is important to understand that the band 16 of supporting material around the lower rounded periphery 12 of the patch 10 can either be knitted into place or be fused after the remainder of the brassiere is knitted together.

It should be further understood that it would be entirely possible, utilizing the construction generally set forth for this invention, to incorporate wires for additional support and strength.

What I claim is:

1. A brassiere construction comprising two breast-supporting portions and supporting strap portions, each breast-supporting portion having a rounded lower periphery and tapering toward the top, the strap portions including straps being attached to and extending around the peripheries of the breast-supporting portions, said latter portions being of unshaped, initially flat stretchable material attached to the said straps, and a band of less stretchable material attached to the said stretchable material of each breast-supporting portion along the rounded lower periphery thereof.

2. The brassiere claimed in claim 1, in which the said stretchable material is 100% nylon capable of accepting a stretch of over 100% of its relaxed dimension without rupture in all directions.

3. The brassiere claimed in claim 2, in which the less stretchable material is a rigid fabric and is fused to the said stretchable material.

4. The brassiere claimed in claim 2, in which the less stretchable material is fibrefill.

* * * * *